United States Patent [19]

Momura

[11] 4,300,769

[45] Nov. 17, 1981

[54] KICKER APPARATUS FOR PINBALL MACHINE

[75] Inventor: Toshihiro J. Momura, Hollywood, Calif.

[73] Assignee: Kabushiki Kaisha Universal, Oyama, Japan

[21] Appl. No.: 110,910

[22] Filed: Jan. 10, 1980

[51] Int. Cl.[3] ..... A63F 7/00

[52] U.S. Cl. ..... 273/129 V

[58] Field of Search ..... 273/129 R, 129 V, 118 A, 273/118 R, 119 A, 119 R, 120 A, 120 R, 121 A, 121 R, 122 A, 122 R, 123 A, 123 R, 124 A, 124 R, 125 A, 125 R, 85 C, 85 D, 85 E, 85 F; 124/41 R, 83; 200/61.11

[56] References Cited

U.S. PATENT DOCUMENTS

| | | | |
|---|---|---|---|
| 712,044 | 10/1902 | Cooper | 273/119 R |
| 1,612,912 | 1/1927 | Esmarian | 273/125 A |
| 2,035,271 | 3/1936 | MacDougall | 273/121 A |
| 2,042,786 | 6/1936 | Hooker | 273/121 A |
| 2,093,293 | 9/1937 | Stoner et al. | 273/129 V |
| 2,317,506 | 4/1943 | Williams et al. | 273/129 V |
| 2,610,058 | 9/1952 | Hooker | 273/121 A |
| 3,901,511 | 8/1975 | Garbark | 273/129 V |
| 4,203,602 | 5/1980 | Kral | 273/121 A |

*Primary Examiner*—Richard C. Pinkham
*Assistant Examiner*—T. Brown
*Attorney, Agent, or Firm*—Young & Thompson

[57] ABSTRACT

Kicker apparatus for a pinball machine having an inclined playing surface, comprises a kicker and mechanism for triggering the kicker to strike a ball and drive the ball up the inclined playing surface. The kicker is disposed in a triangular aperture in the playing surface, two of whose sides converge in the direction in which the ball is projected by the kicker, thereby to direct the ball without the need for upstanding guide members. The triangular aperture is closed from beneath by a plate that is mounted for downward movement under the weight of the ball as the ball rolls down into the triangular aperture by gravity, the plate actuating the triggering mechanism for the kicker.

5 Claims, 5 Drawing Figures

KICKER APPARATUS FOR PINBALL MACHINE

BACKGROUND OF THE INVENTION

The present invention relates to kicker apparatus for use in pinball machines, particularly of the type in which the kicker apparatus strikes a round ball to drive the ball upwardly along an inclined playing surface down which the ball has rolled under the influence of gravity.

Various types of kicker apparatus are already known. One, for example, is generally mushroom-shaped and has inclined side surfaces and springs up from the playing surface to change the direction of movement of a ball. Another type of known kicker apparatus has an impeller which projects above the playing surface and swings to strike the ball. Although the first-mentioned type of kicker apparatus can be installed anywhere on the playing surface, because it can direct the ball in any desired direction, the second type of kicker apparatus, as heretofore provided, is somewhat more restricted in location, because the latter type of kicker apparatus merely reverses the direction of movement of the ball and sends it back up the inclined surface. Therefore, the latter type of kicker apparatus is usually provided with a passageway defined between two upstanding guide members or the like, between which the ball rolls under the influence of gravity toward the kicker member, and between which the ball is driven at higher velocity in the opposite direction by the kicker member. This latter type of kicker apparatus is also provided with a ball-actuated switch in that passageway, which is contacted by the downwardly rolling ball to actuate the kicker apparatus.

However, the latter type of kicker apparatus is disadvantageous because it requires members providing the described passageway and so is of relatively complicated structure and greater cost. Furthermore, the position in which such kicker apparatus can be located is limited due to the need to provide the passageway between the guide members; and for this reason, the known kicker apparatus is usually located adjacent an end of the playing surface so that the kicker apparatus and associated guide members do not obstruct an important portion of the playing surface.

OBJECTS OF THE INVENTION

It is accordingly a principal object of the present invention to provide kicker apparatus for pinball machines, which eliminates the need for guide members upstanding from the playing surface.

Another object of the present invention is the provision of such kicker apparatus, in which the ball-detecting means that actuate the kicker do not project above the playing surface.

Finally, it is an object of the present invention to provide such kicker apparatus, which will be relatively simple and inexpensive to manufacture, reliable in operation, and rugged and durable in use.

SUMMARY OF THE INVENTION

The objects of the invention are achieved by providing kicker apparatus for pinball machines, which is located adjacent the base of a generally triangular aperture formed in the playing surface, the apex of the triangle being disposed in a direction up the incline of the inclined playing surface. Within or under the triangular aperture, a ball-detecting plate is disposed which is mounted for downward movement under the weight of a ball that rolls down the incline and into the triangular aperture, and that upon such downward movement triggers the electric circuit that actuates the kicker. The kicker kicks in a direction toward the apex of the triangle; and upon such reverse movement of the ball, the upwardly converging side walls of the triangular aperture serve as a guide to direct the movement of the ball up the inclined playing surface.

Preferably, the plate that closes the aperture has an area larger than that of the aperture and is disposed below the aperture and closes it and so serves a double function, both as a ball detector and as a closure for the triangular aperture. Alternatively, of course, the plate can have an area less than the triangular aperture and so be disposed within the triangular aperture flush with the playing surface.

BRIEF DESCRIPTION OF THE DRAWINGS

These and other objects, features and advantages of the present invention will become apparent from a consideration of the following description, taken in connection with the accompanying drawings, in which.

DETAILED DESCRIPTION OF THE INVENTION

Figure 1:
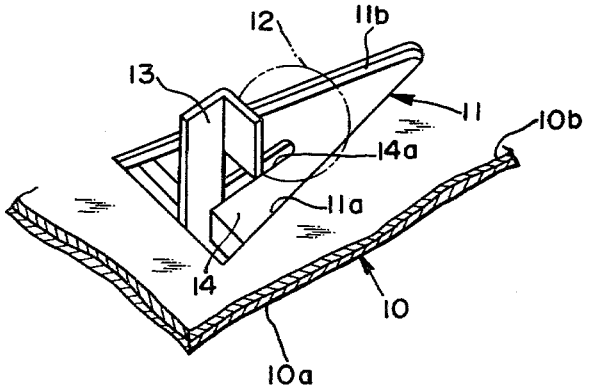
FIG. 1 is a fragmentary perspective view of kicker apparatus for pinball machines according to the present invention, the pinball machines having an inclined playing surface which downwardly declines from the upper right of FIG. 1 to the lower left of FIG. 1.

Referring now to the drawings in greater detail, and first to FIG. 1 thereof, there is shown kicker apparatus for pinball machines, according to the present invention, comprising a playing surface 10 that downwardly declines from the upper right of FIG. 1 to the lower left of FIG. 1, and that is comprised by a steel sheet 10*a* about 1/16-inch thick covered by a thin plastic layer 10*b* of a synthetic resin such as urethane. An aperture 11 in the form of an isoceles triangle is cut through playing surface 10 and has its major sides 11*a* and 11*b* converging in a direction up the slope of playing surface 10.

A conventional spherical ball 12 is provided, which rolls down playing surface 10 under the influence of gravity, along aperture 11 on the edges 11*a* and 11*b* thereof, and into contact with kicker 13 which extends upwardly through aperture 11 a distance above playing surface 10. A ball-detecting plate 14 closes aperture 11 from below and is mounted for downward movement under the weight of ball 12, as ball 12 rolls downwardly along downwardly diverging edges 11*a* and 11*b* and thus settles progressively deeper into aperture 11 and progressively depresses plates 14. At a certain point in its depression, plate 14 actuates microswitch 15 shown in FIG. 3, namely, when ball 12 is either in contact with or not far from kicker 13. Microswitch 15 energizes solenoid 16, which acts to swing kicker 13 quickly in a clockwise direction as shown by the arrow in FIG. 2, to kick ball 12 back up the inclined playing surface 10. In this upward movement, ball 12 rolls back along upwardly converging edges 11*a* and 11*b* of aperture 11, which thus guide the ball on its return or upward movement toward and beyond the vertex of triangular aperture 11. A slot 14*a* is provided in plate 14, in which kicker 13 can swing without interference with plate 14. It will be noted that plate 14 substantially fills aperture 11.

Figure 2:
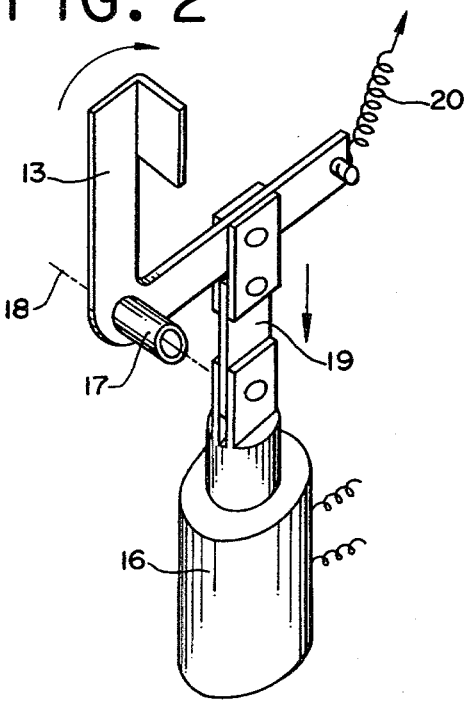
FIG. 2 is a perspective view of the drive mechanism for the kicker.

The structure of kicker 13 and its actuating mechanism is shown in somewhat greater detail in FIG. 2, from which it will be seen that kicker 13 is generally L-shaped and at its elbow is provided with a sleeve 17 mounted for rotation on a shaft 18 in the stationary structure of the pinball machine. Kicker 13 is connected to solenoid 16 by means of an interconnecting member 19; while the end of kicker 13 opposite the end which contacts the ball, is continuously urged in a counterclockwise direction, that is, toward a retracted position of the kicker, by a coil tension spring 20.

When microswitch 15 is contacted so as to actuate solenoid 16, kicker 13 is rapidly rotated about shaft 18 against the action of spring 20. Solenoid 16 may be maintained activated for a short and predetermined period of time by means of a timer circuit or a microcomputer well known in this art. This predetermined period is that which is sufficient for kicker 13 to strike and follow through sufficiently to impart the desired impetus to the ball. In this way, as is well known, various difficulties such as incomplete action of the solenoid, chattering of a microswitch, and incomplete striking operation of the kicker, or the like, may be eliminated.

Figure 4:
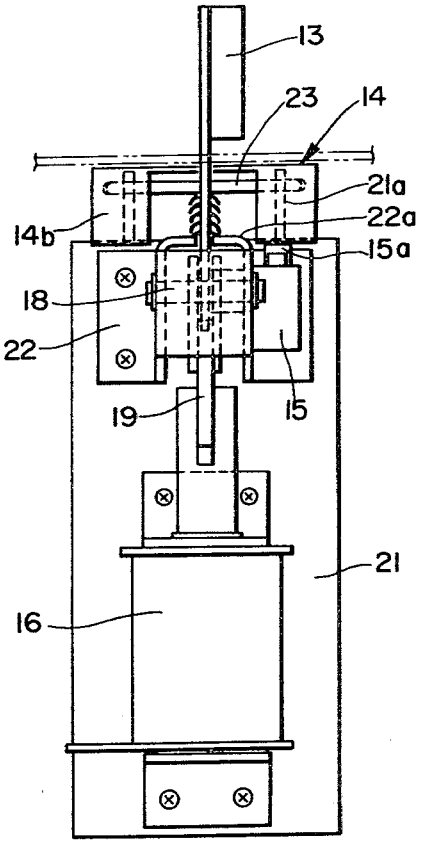
FIG. 4 is a view from the left of FIG. 3.
Figure 3:
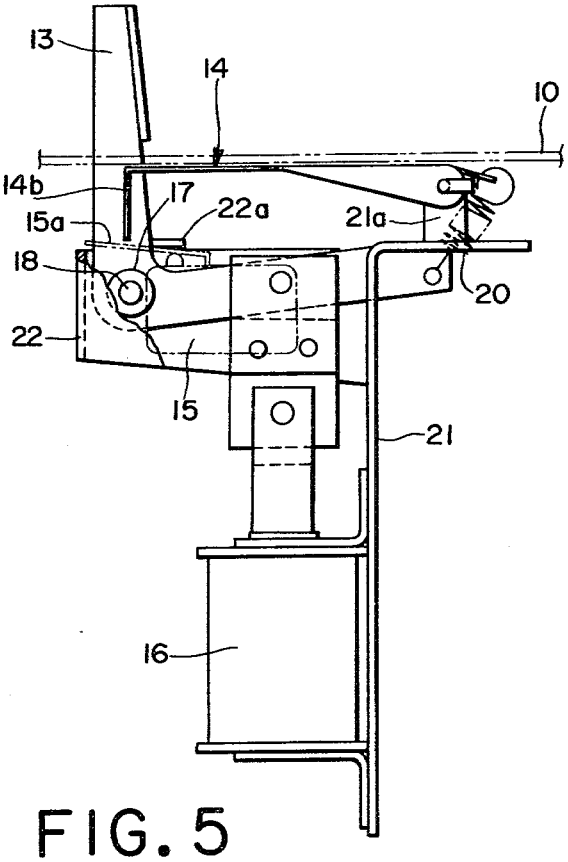
FIG. 3 is a side elevational view of the kicker and its actuating mechanism.
Figure 5:
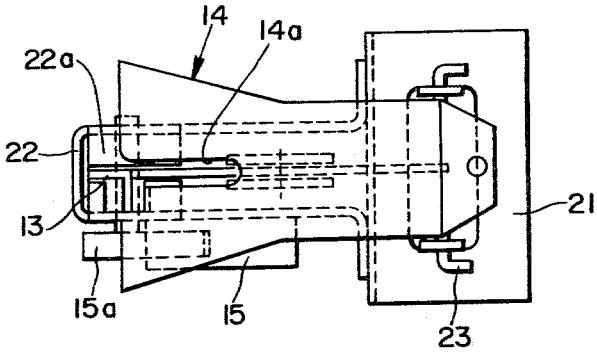
FIG. 5 is a view from the top of FIG. 3.

Further details of the structure and mounting of the kicker and its actuator, are shown in FIGS. 3–5. The solenoid 16 is shown mounted on a base bracket 21 that has a horizontal flange at its upper end and that is fixedly mounted on the stationary structure of the pinball machine. Above the location of the mounting of solenoid 16, a guide arm 22 is mounted on bracket 21, which guide arm has two legs between which the shaft 18 is mounted, a portion of kicker 13 thus being disposed for vertical swinging movement between these two legs. Arm 22 is also provided with a pair of inwardly directed flanges 22*a* disposed generally above shaft 18, between which kicker 13 can swing.

On the upper horizontal flange of bracket 21, there is secured a pair of upstanding support members 21*a* on which is pivotally mounted one end of plate 14 by means of a shaft 23. Spring 20 acts between kicker 13 and a portion of plate 14 in such a manner as to urge plate 14 up toward the closed position shown in the drawings, against the action of spring 20, that is clockwise as seen in FIG. 3. The strength of spring 20, however, is so selected as to permit plate 14 to swing down counterclockwise as seen in FIG. 3, under the weight of ball 12. The free end of plate 14 is downwardly bent at 14*b* to contact an actuator member 15*a* of microswitch 15.

From a consideration of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. For example, although aperture 11 is shown triangular in shape, it can have a variety of other shapes, the important relationship being that the edges 11*a* and 11*b* thereof, whether straight or otherwise formed, should converge upwardly with respect to the inclination of the playing surface 10, so that the portions of the edges 11*a* and 11*b* down which ball 12 rolls under the influence of gravity will diverge and the portions of edges 11*a* and 11*b* along which ball 12 is propelled in the opposite direction by kicker 13, will converge. These and other modifications and variations can be resorted to without departing from the scope of the present invention as defined by the appended claims.

What is claimed is:

1. In kicker apparatus for pinball machines, comprising an inclined playing surface, a kicker for being contacted by a ball which rolls down said playing surface under the influence of gravity, a plate which is depressed by the weight of a ball approaching said kicker, and actuating means to actuate said kicker to impel the ball backward upon said plate being depressed; the improvement comprising an aperture in the playing surface, the aperture having opposite side edges on which the ball rolls in its movement toward and away from the kicker, said edges diverging from each other in the direction of movement of the ball toward the kicker and converging toward each other in the direction of movement of the ball away from the kicker, said plate being located in said aperture, and spring means interconnecting said kicker and plate to urge said kicker backward and said plate upward.

2. Apparatus as claimed in claim 1, said plate being so positioned as to cover said aperture under said playing surface.

3. Apparatus as claimed in claim 2, a part of said kicker projecting above said playing surface through said aperture and said plate having a slot in which said kicker moves forward.

4. Apparatus as claimed in claim 1, said kicker being L-shaped with the horizontal portion thereof connected with said actuating means and the end of said spring means and the vertical portion thereof projecting above said playing surface.

5. In a surface ball rolling apparatus including a playing surface and kicker apparatus for striking a ball which rolls down said playing surface under the influence of gravity; the improvement comprising an aperture in the playing surface having a V-shape with opposite side edges which diverge from each other downwardly towards said kicker, an L-shaped kicker pivotally mounted by the corner thereof and having a vertical portion projecting above said playing surface through said aperture and a horizontal portion below the aperture, actuating means being connected with a part of said horizontal portion to move said kicker forward to strike the ball upon actuation thereof, a plate located in said aperture and adapted to be depressed by the weight of said ball rolling down toward said kicker, switching means for detecting said depression of plate to actuate said actuating means, spring means interconnecting said plate and kicker to urge said plate upward and said kicker backward, and a bracket supporting said kicker and plate swingably and said actuating means rigidly.

* * * * *